US009309793B2

(12) United States Patent
Garrard

(10) Patent No.: US 9,309,793 B2
(45) Date of Patent: Apr. 12, 2016

(54) OIL RETURN TO THE SUMP OF A FLAT ENGINE

(71) Applicant: EcoMotors, Inc., Allen Park, MI (US)

(72) Inventor: Tyler Garrard, Buellton, CA (US)

(73) Assignee: EcoMotors, Inc., Allen Park, MI (US)

( * ) Notice: Subject to any disclaimer, the term of this patent is extended or adjusted under 35 U.S.C. 154(b) by 0 days.

(21) Appl. No.: 14/171,795

(22) Filed: Feb. 4, 2014

(65) Prior Publication Data

US 2014/0216391 A1 Aug. 7, 2014

Related U.S. Application Data

(60) Provisional application No. 61/760,233, filed on Feb. 4, 2013.

(51) Int. Cl.

| | |
|---|---|
| ***F01M 1/02*** | (2006.01) |
| ***F01M 1/16*** | (2006.01) |
| ***F01M 3/00*** | (2006.01) |
| ***F01B 7/08*** | (2006.01) |
| ***F02B 75/28*** | (2006.01) |

(52) U.S. Cl.

CPC .. *F01M 1/02* (2013.01); *F01B 7/08* (2013.01); *F01M 1/16* (2013.01); *F01M 3/00* (2013.01); *F02B 75/282* (2013.01)

(58) Field of Classification Search

CPC ..... F02B 25/26; F02B 75/24; F01M 1/02; F01M 11/0004; F01M 2011/0037; F01M 2011/0041; F16N 2270/00; F16N 2270/48; F16N 2270/60

USPC ..... 123/196, 198

See application file for complete search history.

(56) References Cited

U.S. PATENT DOCUMENTS

| | | | | |
|---|---|---|---|---|
| 4,539,949 | A | 9/1985 | Walsworth | |
| 4,690,108 | A | 9/1987 | Debevec | |
| 4,932,370 | A | 6/1990 | Schierling | |
| 5,197,417 | A | 3/1993 | Tuckermann | |
| 5,517,959 | A * | 5/1996 | Kato et al. | 123/196 AB |
| 5,975,042 | A | 11/1999 | Aizawa | |
| 2006/0118070 | A1 | 6/2006 | Branston | |
| 2006/0124084 | A1 * | 6/2006 | Hofbauer et al. | 123/55.7 |

* cited by examiner

*Primary Examiner* — Lindsay Low
*Assistant Examiner* — Kevin Lathers
(74) *Attorney, Agent, or Firm* — Barnes & Thornburg LLP

(57) ABSTRACT

Returning engine oil to the primary oil sump from outboard locations in a flat engine can be a challenge. In the present disclosure, the pressure fluctuations occurring at the underside of the piston, due to reciprocation of the piston, are used to pump the oil from outboard locations to the primary oil sump. To prevent backflow of oil during periods of negative pressure difference, a check valve is placed in the oil drain passage. The check valve allows flow from the outboard location to the primary oil sump and no flow from the primary oil sump to the outboard location by opening and closing as driven by pressure fluctuations due to piston reciprocation. Such a check valve also prevents backflow of the oil to one of the outboard locations when the engine is tilted.

20 Claims, 3 Drawing Sheets

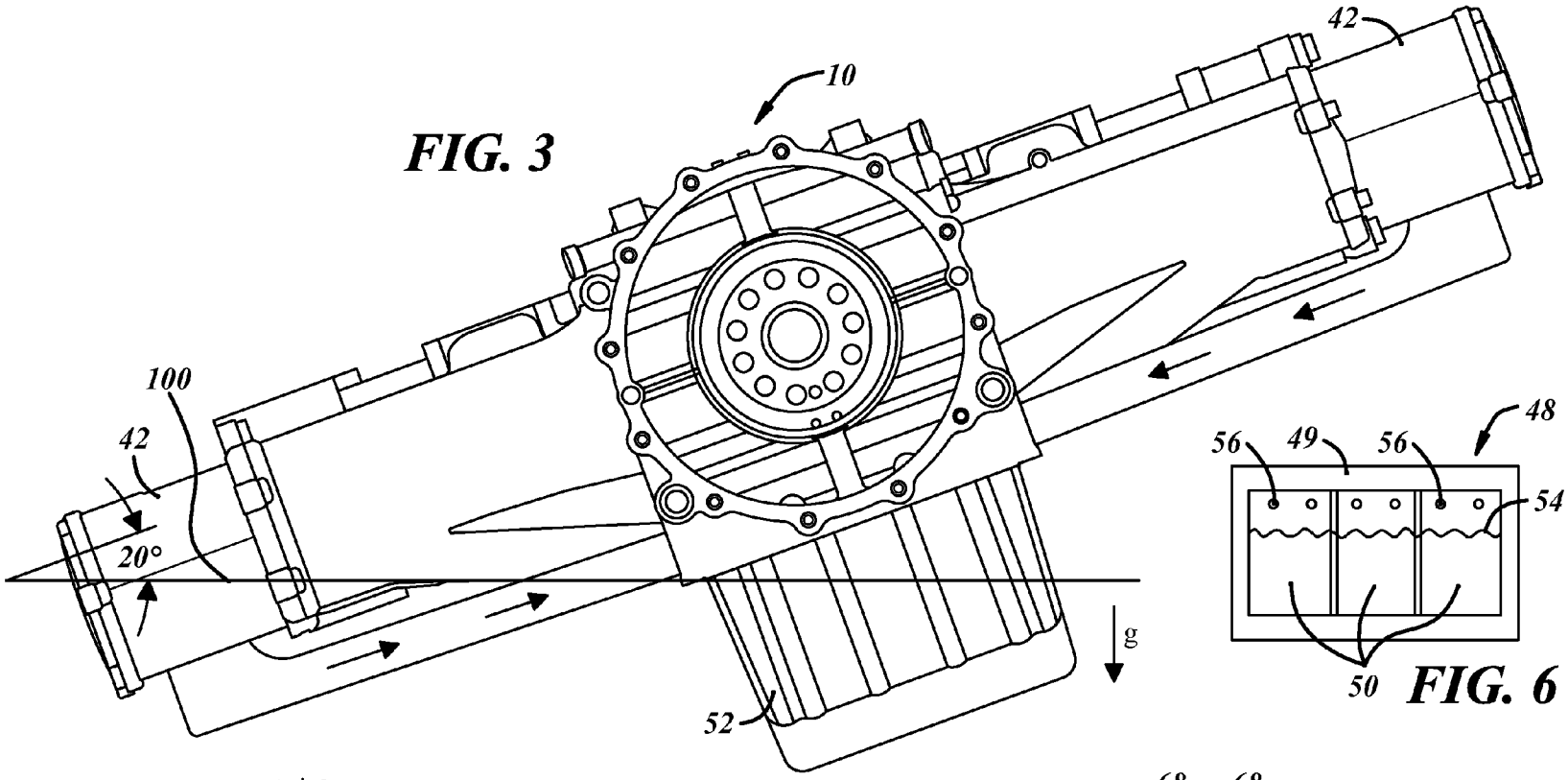
FIG. 3
FIG. 6
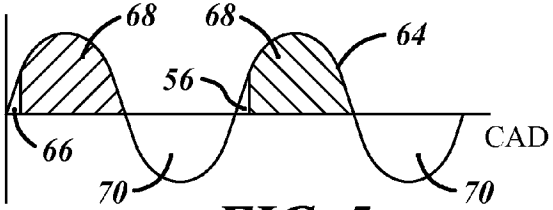
FIG. 5
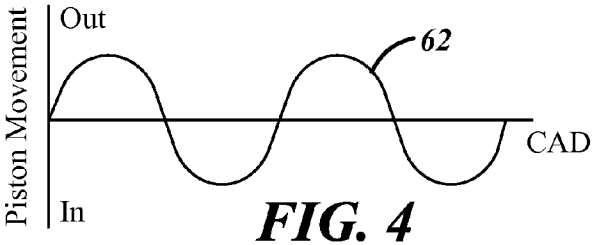
FIG. 4

OIL RETURN TO THE SUMP OF A FLAT ENGINE

FIELD

The present disclosure relates to providing oil return for an engine with a wet sump.

BACKGROUND

A flat engine is an internal-combustion engine with multiple pistons that move in a horizontal plane. In FIG. 1, one such engine, an opposed-piston, opposed-cylinder (OPOC) engine 10, is shown isometrically and partially exploded. An intake piston 12 and an exhaust piston 14 reciprocate in a first cylinder 26 and an intake piston 22 and an exhaust piston 24 reciprocate in a second cylinder 28. Exhaust piston 24 and intake piston 12 couple to a journal (not visible) of crankshaft 20 via pushrods 16. Only half of cylinders 26 and 28 are shown exploded from pistons 12, 14, 22, and 24 so that the features can be more easily viewed. Cylinders 26 and 28 each have intake ports 30 and exhaust ports 32 Intake piston 22 and exhaust piston 14 couple to two journals (not visible) of crankshaft 20 via pullrods 18, with each of intake piston 22 and exhaust piston 14 having two pullrods 18. A well-known issue with flat engines is in controlling oil, i.e., returning it to the sump to avoid oil pooling in the outer extremities due to a lack of natural gravity draining effect. Also, with a flat engine layout, if the engine is tipped, e.g., parked at an angle, oil may flow from the sump toward the extremity that is dropped lower. If the angle is extreme, the level of oil could be such that the engine becomes hydraulically locked. If the engine is not operating while at the extreme angle, the engine would not start. If the engine is operating, the engine could be damaged.

SUMMARY

An engine is disclosed that has an engine block having at least one cylinder, a piston reciprocating within the cylinder, a combustion chamber disposed on one side of the piston and an outboard chamber disposed on the other side of the piston. A crankshaft is disposed in the engine block and coupled to the piston by a connecting rod. A primary sump is coupled to the engine block and located generally below the crankshaft. An auxiliary sump is fluidly coupled to the outboard chamber and located generally below the outboard chamber. A drain passage fluidly couples the primary sump with the auxiliary sump. The drain passage has a check valve disposed therein. The auxiliary sump may be a defined space or merely space that exists in the end of the cylinder.

The check valve is a normally-closed valve that opens when pressure in the auxiliary sump exceeds the pressure in the primary sump by a predetermined amount. The check valve may be a reed valve, a flapper valve, a ball valve, or any other suitable valve.

The present disclosure applies to all engines, but is particularly useful in flat engines in which the primary sump is displaced from the auxiliary sump.

Also disclosed in an internal combustion engine that has first and second cylinders defined in the engine block. A crankshaft is disposed between the first and second cylinders. A first inner piston and a first outer piston are disposed in the first cylinder and the pistons are coupled to the crankshaft. A second inner piston and a second outer piston are disposed in the second cylinder with the pistons coupled to the crankshaft. A primary sump is coupled to the engine block and located generally below the crankshaft. A first chamber is located outboard of the first outer piston. A second chamber located outboard of the second outer piston. A first auxiliary sump is fluidly coupled to the first chamber and located substantially below the first chamber. A second auxiliary sump fluidly coupled to the second chamber and located substantially below the second chamber. A first drain passage fluidly couples the primary sump with the first auxiliary sump and a second drain passage fluidly couples the secondary sump with the second auxiliary sump. A first check valve is disposed in the first drain passage. A second check valve disposed in the second drain passage. The first check valve is a normally-closed valve and opens when pressure in the first auxiliary sump exceeds the pressure in the primary sump by a first predetermined amount. The second check valve is a normally-closed valve and opens when pressure in the second auxiliary sump exceeds the pressure in the primary sump by a second predetermined amount. In some embodiments, the first predetermine amount substantially equals the second predetermine amount.

In one embodiment, the first and second drain passages are integral to the engine block. In another embodiment, the first and second drain passages are separate from the engine block. A first end of the first drain passage couples to the first chamber and a second end of the first drain passage couples to the engine block proximate the primary sump. A first end of the second drain passage couples to the second chamber and a second end of the second drain passage couples to the engine block proximate the primary sump. Alternatively, a first end of the first drain passage couples to the first chamber and a second end of the first drain passage couple to the primary sump; and a first end of the second drain passage couples to the second chamber and a second end of the second drain passage couples to the primary sump.

When the engine is in a neutral position, the first drain passage angles downwardly from the first auxiliary sump to the primary sump and the second drain passage angles downwardly from the second auxiliary sump to the primary sump.

According to the present disclosure, the pressure fluctuations due to piston reciprocation are advantageously used to pump oil from outboard locations to the primary sump.

According to an advantage of the disclosure, the engine is protected against excessive oil buildup in outboard locations and to avoid the potential for hydraulic locking of the engine when the engine is tilted.

In one embodiment, the oil passage between the auxiliary sump and the primary sump is integral with the engine block. The extra material in the block for the oil passage can advantageously provide stiffness to the engine block, as a rib of sorts.

The present disclosure applies to any engine that is designed to undergo an angular displacement such that oil drainage could present an issue.

BRIEF DESCRIPTION OF THE DRAWINGS

FIG. 3 is a front view of the engine of FIG. 1 in a tilted position;

FIG. 4 is a graph of piston position as a function of crank angle degree; and FIG. 5 is a graph of ΔP (pressure in the auxiliary sump minus pressure in the primary sump) as a function of crank angle degree; and FIG. 6 is a detail of the reed valve shown in FIGS. 2 and 3.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
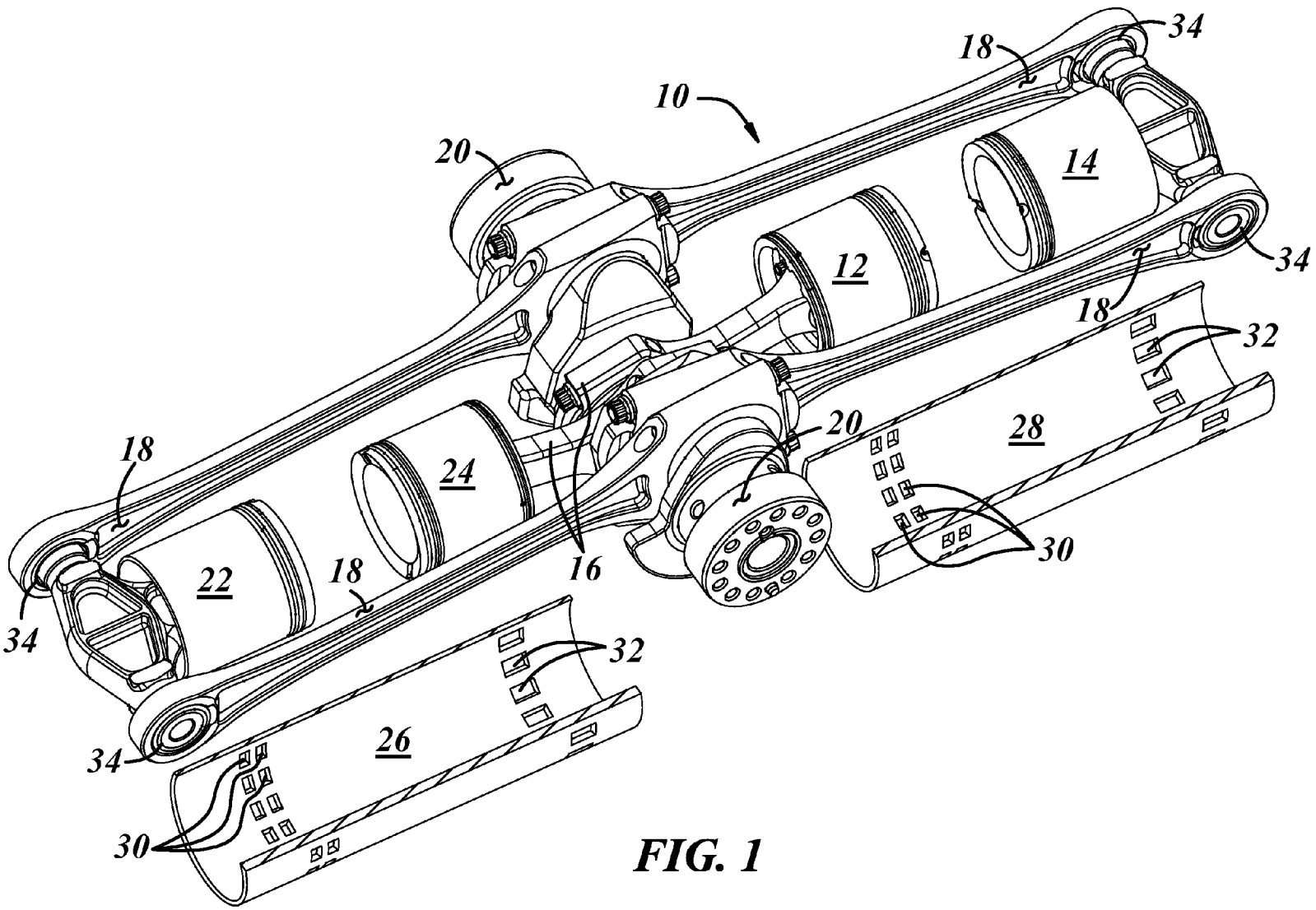
FIG. 1 is an isometric view of a flat engine.

Referring to FIG. 1, it is known to spray engine oil onto the underside of pistons 12, 14, 22, and 24. Furthermore, pressurized oil may be provided to moving joints 34 associated with pullrods 18 through small oil passages in engine components. The sprayed oil onto pistons 22 and 14 and the oil that seeps out from the joints 34 is collected within an end cap (not shown) and returned to a primary oil sump (also not shown) that is located under crankshaft 20.

Figure 2:
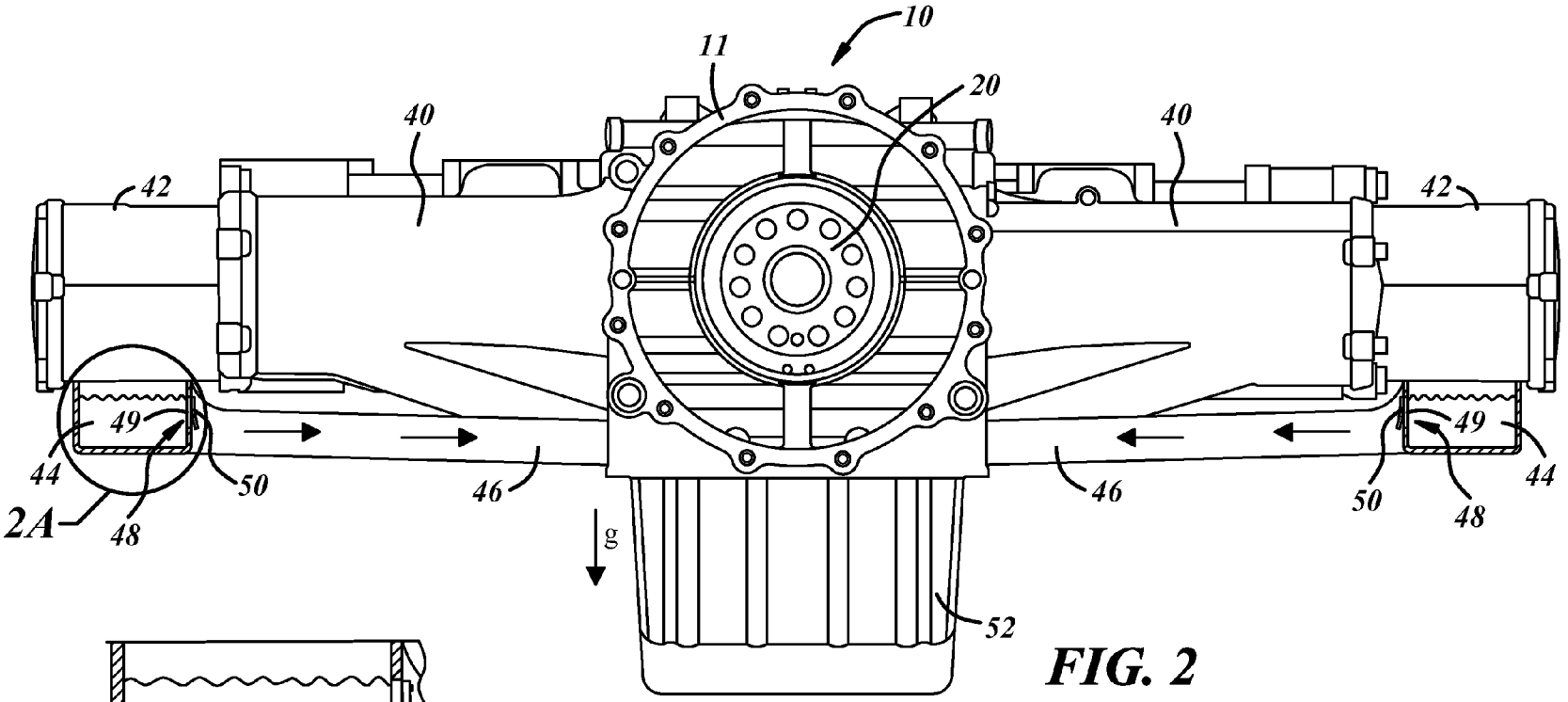
FIG. 2 is a front view of the engine of FIG. 1 in a neutral position.

An external view of engine 10 is shown in FIG. 2. Engine 10 is shown in its neutral position, meaning that the left and right sides of the engine are at about the same height. Engine 10 has an engine block 11 with left and right sides 40 that house left and right cylinders. Oil that collects in outboard chambers 42 drains into auxiliary sumps 44 and can drain through oil return passages 46 into a primary sump 52 that is located substantially below crankshaft 20. An oil pump (not shown) may be provided in primary sump 52 to pressurize the oil to recirculate the oil through the engine.

Figure 2A:
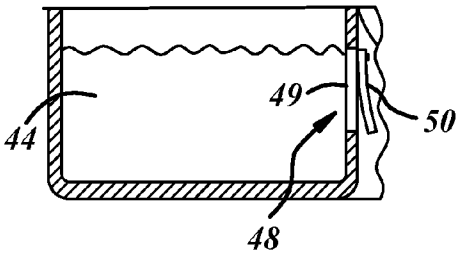
FIG. 2A is a detail of auxiliary sump.

Oil passages 46 are shown in FIG. 2 to be horizontal and coupled to the engine block 11. Alternatively, the oil passages may slope downwardly from outboard chambers 42 toward primary sump 52 and couple directly to primary sump 52 rather than to engine block 11. Oil return passages 46 are shown as separate elements coupled to engine 10. Alternatively, oil return passages 46 may be integrally formed in engine block 11. Auxiliary sump 44 is shown in FIG. 2 as being a separate component. In an alternative, auxiliary sump 44 may be integrally formed with outboard chamber 42. A detail of auxiliary sump 44 is shown in FIG. 2A.

In FIG. 3, engine 10 is shown at a 20° angle. Not only is oil not scavenged from the left hand cylinder, but oil backflows toward the left hand cylinder. The oil level 100 in outboard chamber 42 may hydraulic the left outer piston (piston 22 of FIG. 1). Even if such a potentially damaging result is avoided, the oil pooling in the outboard chamber 42 may increase oil consumption thereby affecting emissions, engine deposits, and oil level.

Referring to FIG. 2, a one-way valve or check valve 48 is placed between auxiliary sump 44 and drain passage 46. Valve 48 opens to allow flow from auxiliary sump 44 to drain passage 46, but when closed, valve 48 largely prevents backflow from drain passage 46 to auxiliary sump 44 and outboard chamber 22 even when engine 10 is tilted.

Reciprocation of the outer piston (22 in the left cylinder 26 and 14 in the right cylinder 28) causes pressure fluctuations in outboard chamber 42. Movement of the piston is shown graphically as curve 62 for two cycles in FIG. 4. When the piston moves outwardly toward outboard chamber 42, pressure in outboard chamber 42 increases. When the piston moves away from outboard chamber 42, pressure in outboard chamber 42 decreases.

Valve 48, as shown in the embodiment in FIG. 2, is a reed valve block. Alternatively, the valve may be a flapper valve, a ball valve, or any suitable valve that is able to respond sufficiently fast to the rapidly changing pressure conditions in the system. Valve 48 is a normally-closed valve, i.e., with a slight bias to the closed position provided by petals 50 (only one of which is shown in FIG. 2) acting as a spring. Other valve alternatives are similarly biased closed by a spring or other suitable member.

In FIG. 5, the pressure difference between auxiliary sump 44 and primary sump 52 ($\Delta P$) is plotted as a function of crank angle degree for two cycles (curve 64). At the initial portion of the graph, i.e., corresponding to when the piston is moving toward outboard chamber 42, $\Delta P$ rises. After a short delay, valve 48 opens (at 66) and remains open while $\Delta P$ is positive. When $\Delta P$ becomes negative, valve 48 closes. While valve 48 is open, oil is pumped from auxiliary sump 42 to primary sump 52 due to the positive $\Delta P$. When $\Delta P$ is negative, there is no pumping because valve 48 is closed thereby preventing backflow. In FIG. 5, valve 48 is shown to close as $\Delta P$ becomes negative. Based on the amount of bias on the valve, the dynamics of the valve system, and other factors, valve 48 may close at other times, possibly just before or just after $\Delta P$ becomes negative. Similarly, valve 48 is shown to open at 66 in FIG. 5. However, $\Delta P$ at which valve 48 actually opens depends on many factors affecting the dynamics of valve 48.

Reed valve 48 includes a reed valve block 49 and three reed petals 50 as illustrated in FIG. 6. One end of petals 50 are secured to reed valve block 49 by fasteners 56. Petals 50 are flexible members that bend when acted upon by a pressure difference. However, in the absence of a pressure difference, petals 50 are biased to sit against reed valve block 49.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art implementations with respect to one or more characteristics are not outside the scope of the disclosure and may be desirable for particular applications.

I claim:

1. An internal combustion engine, comprising:

an engine block;

a cylinder defined in the engine block;

a piston reciprocating within the cylinder with a combustion chamber disposed on one side of the piston and an outboard chamber disposed on the other side of the piston;

a crankshaft disposed in the engine block and coupled to the piston by a connecting rod;

a primary sump coupled to the engine block;

an auxiliary sump fluidly coupled to the outboard chamber;

a drain passage fluidly coupling the primary sump with the auxiliary sump; and a check valve disposed in the drain passage, the drain passage and check valve together providing for flow through the drain passage from the auxiliary sump directly to the primary sump when the check valve is open.

2. The engine of claim 1 wherein the check valve is a normally-closed valve that opens when pressure in the auxiliary sump exceeds the pressure in the primary sump by a predetermined amount.

3. The engine of claim 2 wherein the check valve is a reed valve.

4. The engine of claim 2 wherein the check valve is a flapper valve.

5. The engine of claim 2 wherein the check valve is a ball valve.

6. The engine of claim 1 wherein the engine is a flat engine and the primary sump is displaced from the auxiliary sump.

7. The engine of claim 1 wherein when the engine is in a neutral position, the drain passage angles downwardly from the auxiliary sump to the primary sump.

8. The engine of claim 1 wherein when the engine is in a neutral position, the drain passage is generally flat.

9. The engine of claim 1 wherein the drain passage is integral to the engine block.

10. The engine of claim 1 wherein the drain passage is separate from the engine block.

11. An internal combustion engine, comprising:

an engine block;

first and second cylinders defined in the engine block;

a crankshaft disposed between the first and second cylinders;

a first inner piston and a first outer piston disposed in the first cylinder with the pistons coupled to the crankshaft;

a second inner piston and a second outer piston disposed in the second cylinder with the pistons coupled to the crankshaft;

a primary sump coupled to the engine block;

a first chamber located outboard of the first outer piston;

a second chamber located outboard of the second outer piston;

a first auxiliary sump fluidly coupled to the first chamber;

a second auxiliary sump fluidly coupled to the second chamber;

a first drain passage fluidly coupling the primary sump with the first auxiliary sump; and a second drain passage fluidly coupling the primary sump with the second auxiliary sump.

12. The engine of claim 11, further comprising:

a first check valve disposed in the first drain passage; and a second check valve disposed in the second drain passage.

13. The engine of claim 12 wherein:

the first check valve is a normally-closed valve and opens when pressure in the first auxiliary sump exceeds the pressure in the primary sump by a first predetermined amount; and the second check valve is a normally-closed valve and opens when pressure in the second auxiliary sump exceeds the pressure in the primary sump by a second predetermined amount.

14. The engine of claim 13 wherein the first predetermined amount substantially equals the second predetermined amount.

15. The engine of claim 12 wherein the first check valve is one of: a reed valve; a flapper valve; and a ball valve.

16. The engine of claim 11 wherein the first and second drain passages are integral to the engine block.

17. The engine of claim 11 wherein:

the first and second drain passages are separate from the engine block;

a first end of the first drain passage couples to the first chamber and a second end of the first drain passage couples to the engine block proximate the primary sump; and a first end of the second drain passage couples to the second chamber and a second end of the second drain passage couples to the engine block proximate the primary sump.

18. The engine of claim 11 wherein:

the first and second drain passages are separate from the engine block;

a first end of the first drain passage couples to the first chamber and a second end of the first drain passage couples to the primary sump; and a first end of the second drain passage couples to the second chamber and a second end of the second drain passage couples to the primary sump.

19. The engine of claim 11 wherein when the engine is in a neutral position:

the first drain passage angles downwardly from the first auxiliary sump to the primary sump; and the second drain passage angles downwardly from the second auxiliary sump to the primary sump.

20. An internal combustion engine, comprising:

an engine block;

a cylinder defined in the engine block;

a piston reciprocating within the cylinder with a combustion chamber disposed on one side of the piston and an outboard chamber disposed on the other side of the piston;

a crankshaft disposed in the engine block and coupled to the piston by a connecting rod;

a primary sump coupled to the engine block;

an auxiliary sump fluidly coupled to the outboard chamber;

a drain passage fluidly coupling the primary sump with the auxiliary sump; and a flapper valve disposed in the drain passage wherein the flapper valve is a normally-closed valve that opens when pressure in the auxiliary sump exceeds the pressure in the primary sump by a predetermined amount to provide for flow through the drain passage from the auxiliary pump directly to the primary pump.

* * * * *